US010955767B2

(12) United States Patent
Takeuchi

(10) Patent No.: US 10,955,767 B2
(45) Date of Patent: Mar. 23, 2021

(54) IMAGE FORMING APPARATUS

(71) Applicant: CANON KABUSHIKI KAISHA, Tokyo (JP)

(72) Inventor: Kosuke Takeuchi, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/662,623

(22) Filed: Oct. 24, 2019

(65) Prior Publication Data

US 2020/0142333 A1 May 7, 2020

(30) Foreign Application Priority Data

Nov. 6, 2018 (JP) ..... JP2018-209081

(51) Int. Cl.
*G03G 15/08* (2006.01)
*G03G 15/09* (2006.01)

(52) U.S. Cl.
CPC ..... *G03G 15/0889* (2013.01); *G03G 15/0898* (2013.01); *G03G 15/0942* (2013.01)

(58) Field of Classification Search
CPC ..... G03G 15/0817; G03G 15/0887; G03G 15/0889; G03G 15/0891; G03G 15/0898; G03G 15/0942
See application file for complete search history.

(56) References Cited

U.S. PATENT DOCUMENTS

| | | | | |
|---|---|---|---|---|
| 8,843,015 | B2 | 9/2014 | Utsunomiya et al. | |
| 10,481,521 | B2 * | 11/2019 | Soeta | G03G 15/0808 |
| 2016/0054675 | A1 | 2/2016 | Takeuchi et al. | |
| 2016/0070208 | A1 * | 3/2016 | Kikuchi | G03G 15/0891 399/254 |
| 2016/0216640 | A1 | 7/2016 | Nose et al. | |

FOREIGN PATENT DOCUMENTS

| | | | |
|---|---|---|---|
| JP | H01-102588 | A | 4/1989 |
| JP | 2005-084372 | A | 3/2005 |
| JP | 2012-198290 | A | 10/2012 |
| JP | 2015-025925 | A | 2/2015 |

* cited by examiner

*Primary Examiner* — Hoang X Ngo
(74) *Attorney, Agent, or Firm* — Venable LLP

(57) ABSTRACT

In an image forming apparatus, a shortest distance at which a developer container is closest to an image bearing member and which is disposed downstream of a first magnetic pole and upstream of second magnetic pole of a magnet fixed within a developer bearing member is 2.5 mm or less, and a position at which a magnetic flux density in a normal direction of the developer bearing member is zeroed and which is disposed downstream of the first magnetic pole and upstream of the second magnetic pole in the rotation direction of the developer bearing member on the developer bearing member is positioned upstream of the position at which the developer container is closest to the image bearing member and which is disposed downstream of the first magnetic pole and upstream of the second magnetic pole.

6 Claims, 12 Drawing Sheets

IMAGE FORMING APPARATUS

BACKGROUND OF THE INVENTION

Field of the Invention

The present invention relates to an image forming apparatus such as a copier, a printer, a facsimile machine and a multi-function printer having a plurality of functions of those machines.

Description of the Related Art

An image forming apparatus is provided with a developing apparatus developing an electrostatic latent image formed on an image bearing member such as a photosensitive drum by developer. Such developing apparatus includes a developer bearing member such as a developing sleeve bearing the developer stored in a developer container and conveying to an area facing the photosensitive drum to form a toner image. At this time, however, there is a case where the developer scatters out of the developer container and stains inside of the developing apparatus. To that end, a configuration for suppressing the developer from scattering out of the developer container has been proposed through contrivance of a shape or a gap of the part facing the developer bearing member of the developer container by Japanese Patent Application Laid-open No. 2015-25925 for example.

However, even if the shape or the gap of the part facing the developer bearing member of the developer container is contrived, it is difficult to fully suppress the developer from scattering out of the gap between the developer container and the developer bearing member.

The present disclosure aims at providing a configuration that enables to suppress the developer from scattering out of the developing apparatus.

SUMMARY OF THE INVENTION

According to one aspect of the present invention, an image forming apparatus includes an image bearing member configured to rotate, and a developing apparatus. The developing apparatus includes a developer container including a partition wall parting a storage space for storing developer into a first storage space and a second storage space provided in parallel with the first storage space and an opening opened at a position facing the image bearing member, a first agitating member configured to rotate within the first storage space to convey the developer, a second agitating member configured to rotate within the second storage space and circulate the developer between the first and second storage spaces together with the first agitating member, and a developer bearing member disposed such that a part of the developer bearing member is exposed out of the opening of the developer container and configured to rotate while bearing the developer within the developer container to convey the developer to a developing area facing the image bearing member so that an electrostatic latent image on the image bearing member is developed. The developer that has passed through the developing area can be collected in the second storage space from the developer bearing member without passing through the first storage space. A distance between the developer container and the image bearing member at a closest position where the developer container is closest to the image bearing member in an area downstream of the opening of the developer container in a rotation direction of the developer bearing member is 2.5 mm or less.

Further features of the present invention will become apparent from the following description of exemplary embodiments with reference to the attached drawings.

DESCRIPTION OF THE EMBODIMENTS

First Embodiment

A first embodiment will be described below with reference to FIGS. 1 through 4.

Figure 1:
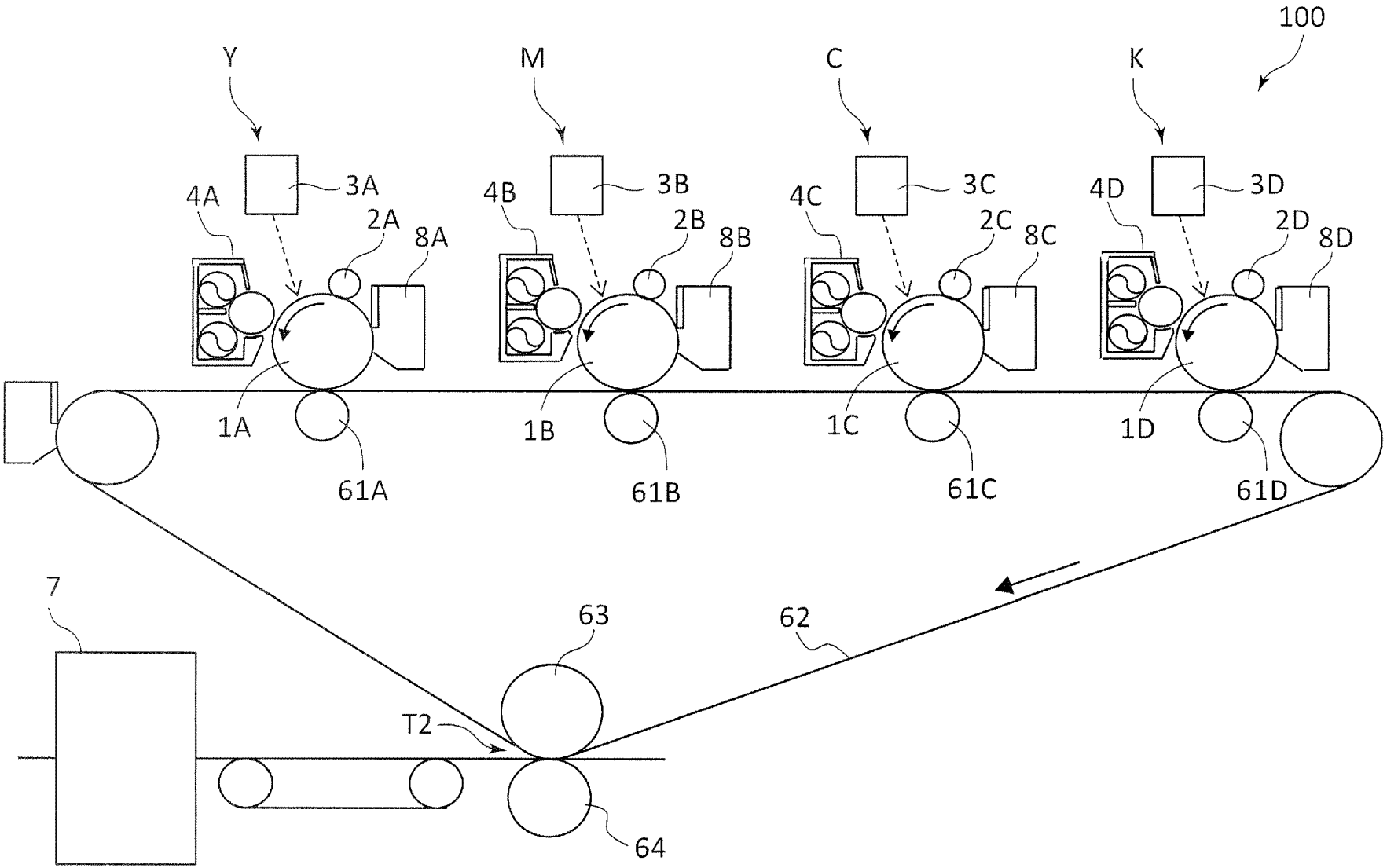
FIG. 1 is a schematic section view illustrating a configuration of an image forming apparatus of a first embodiment.

At first, a schematic configuration of an image forming apparatus of the present embodiment will be described with reference to FIG. 1.

Image Forming Apparatus

The image forming apparatus 100 is a so-called tandem type configuration in which image forming units Y, M, C and K forming four color toner images of yellow, magenta, cyan and black are arrayed along a rotation direction of an intermediate transfer belt 62. The image forming apparatus 100 forms the toner image or an image on a recording material corresponding to image signals from a host apparatus such as a document reading apparatus not illustrated and connected with an image forming apparatus body or a personal computer communicably connected with the apparatus body. The recording member may be a sheet member such as a sheet of paper, a plastic film or a cloth.

It is noted that the four image forming units Y, M, C and K of the image forming apparatus 100 have substantially the same structure except that the developing colors are different. Therefore, the image forming unit Y will be typically described below and descriptions of the other image forming units will be omitted.

The image forming unit Y is provided with a cylindrical photosensitive member, i.e., a photosensitive drum 1A, serving as an image bearing member. The photosensitive drum 1A is rotationally driven in a direction of an arrow in FIG. 1. Disposed around the photosensitive drum 1A are a charging roller 2A serving as a charging unit, a developing apparatus 4A, a primary transfer roller 61A, and a cleaning unit 8A. Disposed above the photosensitive drum 1A in FIG. 1 is a laser scanner 3A serving as an exposing unit.

The intermediate transfer belt 62 serving as an intermediate transfer body is disposed so as to face the photosensitive drums 1A, 1B, 1C and 1D. The intermediate transfer belt 62 is stretched by a plurality of tension rollers and is circularly moved, i.e., is rotated in a direction of an arrow in FIG. 1 by being driven by a driving roller among the plurality of tension rollers. A secondary transfer outer roller 64 is disposed at a position facing a secondary transfer inner roller 63 among the plurality of tension rollers while interposing the intermediate transfer belt 62 and composes a secondary transfer portion T2 where the toner image on the intermediate transfer belt 62 is transferred onto the recording member. A fixing unit 7 is disposed downstream in a recording member conveying direction of the secondary transfer portion T2.

An image forming operation is conducted as follows in the image forming apparatus 100 constructed as described above. At first, a surface of the photosensitive drum 1A is homogeneously charged by the charging roller 2A. The laser scanner 3A exposes the charged surface to form an electrostatic latent image on the photosensitive drum 1A. The electrostatic latent image thus obtained is developed as a toner image by toner applied from the developing apparatus 4A. This toner image is transferred onto the intermediate transfer belt 62 by a primary transfer roller 61A. The image forming units M, C and K also conduct such operations sequentially, and the four-color toner images are superimposed on the intermediate transfer belt 62.

Then, after superimposing and transferring the four-color toner images onto the intermediate transfer belt 62, the four-color toner images are transferred onto the recording member conveyed from a sheet feed cassette not illustrated to the secondary transfer portion T2. The recording member is conveyed to the fixing unit 7 to be heated and pressurized and is then discharged out of the image forming apparatus 100. Residual toner left on the photosensitive drum 1A after the transfer is removed by the cleaning unit 8A.

Developing Apparatus

Next, the developing apparatus 4A of the present embodiment will be described with reference to FIG. 2. Note that because other developing units 4B, 4C and 4D have the same configuration with the developing apparatus 4A, their description and illustration will be omitted here.

The developing apparatus 4A includes a developer container 41, a cylindrical developing sleeve 44 serving as a developer bearing member and a regulation member 42. The developer container 41 is capable of storing the developer composed of non-magnetic toner and magnetic carrier. A part of the developer container 41 facing the photosensitive drum 1A (see FIG. 1) is opened and the developing sleeve 44 is disposed rotatably in the opening 60 such that a part thereof is exposed out of the opening 60.

The developing sleeve 44 is disposed so as to face the photosensitive drum 1A, rotates while bearing the developer within the developer container to convey to the area facing the photosensitive drum 1A, i.e., a developing area, and develops the electrostatic latent image on the photosensitive drum 1A, i.e., the image bearing member. The developing sleeve 44 is disposed such that a rotation axial direction thereof is approximately] in parallel with a rotation axial direction of the photosensitive drum 1A and is rotationally driven in a direction of an arrow a in FIG. 2 by a motor not illustrated. The rotation direction of the developing sleeve 44 is the same (normal direction) with a rotation direction of the photosensitive drum 1A at the position facing the photosensitive drum 1A, i.e., in a direction of β in FIGS. 3 and 4.

The developing sleeve 44 is provided non-rotationally with a magnet roll 48 serving as a magnetic field generating unit. The magnet roll 48 includes a plurality of magnetic poles along the rotation direction of the developing sleeve 44 and magnetically attracts the developer to a surface of the developing sleeve 44. The regulation member 42 is disposed through an intermediary of a predetermined gap from the developing sleeve 44 and regulates a height of magnetic bristles i.e., a thickness of a layer, of the developer formed on the developing sleeve 44. It is noted that the magnetic bristles are what carriers attached with toner are borne on the developing sleeve 44 in a condition of extending like bristles.

The developer container 41 is also parted by a partition wall 43, extending in a horizontal direction, into a first developer conveyance path 45*a* and a second developer conveyance path 45*b*. A first screw 46*a* serving as a first conveyance member is disposed within the first developer conveyance path 45*a*, and a second screw 46*b* serving as a second conveyance member is disposed within the second developer conveyance path 45*b*, respectively.

The first screw 46*a* conveys while agitating the toner replenished from a toner replenishing unit not illustrated to the developer container 41 with the developer within the first developer conveyance path 45*a* to uniform toner concentration. The second screw 46*b* agitates and conveys the developer within the second developer conveyance path 45*b*. Communication ports communicating the first developer conveyance path 45*a* with the second developer conveyance path 45*b* are defined at both widthwise end portions of the partition wall 43, i.e., in the rotation axial direction of the developing sleeve 44, respectively. Thereby, a circulation path circulating the developer through the first developer conveyance path 45*a* and the second developer conveyance path 45*b* is made. In other words, the developer container 41 is divided by the partition wall 43 into a first storage space 45*a* serving as the first developer conveyance path or as a first chamber and a second storage space 45*b* serving as the second developer conveyance path or as a second chamber and provided in parallel above the first storage space 45*a*. Then, the first screw 46*a* serving as a first agitating member rotating within the first storage space and conveying the developer is provided within the first storage space 45*a*. Still further, the second screw 46*b* serving as a second agitating member rotating within the second storage space and circulating the developer between the first storage space 45*a* and the second storage space 45*b* together with the first agitating member is disposed within the second storage space 45*b*. Still further, the developing apparatus 4A of the present embodiment is configured such that the developer passed through the developing area can be collected in the second storage space 45*b* from the developing sleeve 44 without passing through the first storage space 45*a*.

The developer stored within the developer container 41 is a two-component developer in which the negatively charged non-magnetic toner is mixed with the magnetic carrier. The non-magnetic toner contains coloring agent, wax component and others in resin such as polyester and styrene and powdered by pulverization or polymerization. The non-magnetic toner of 5 μm in average grain size was used in the present embodiment. The magnetic carrier is what resin coating is applied to a surface layer of a core composed of a resin particle obtained by kneading ferrite particle and magnetic powder.

A toner developing process on the photosensitive drum 1A in the developing area will be described. After the photosensitive drum 1A is homogeneously charged to a charging potential Vd [V] by the charging roller 2A as described in connection with FIG. 1, an image portion in which an image is to be formed on the photosensitive drum 1A is exposed by the laser scanner 3A to be an exposure potential V1 [V]. A DC voltage or a voltage in which an AC voltage is superimposed on a DC voltage is applied to the developing sleeve 44. When the voltage of the DC component of the developing sleeve 44 is supposed to be Vdc, an absolute value of a difference between the DC voltage and the exposure potential, i.e., |Vdc−V1|, is called as Vcont, and this potential creates an electric field carrying the toner to the image portion.

Still further, an absolute value of a difference between the DC voltage Vdc and the charging potential Vd, i.e., |Vdc−Vd| is called as Vback, and this potential creates an electric field returning the toner in a direction of the developing sleeve 44 from the photosensitive drum 1A. This arrangement is made to suppress a so-called fogging phenomenon by which the toner adheres to a non-image portion.

The magnet roll 48 of the present embodiment includes five magnetic poles S1, N1, S2, N2 and S3. The developing sleeve 44 rotates in a direction of an arrow a in FIG. 2 and attracts the developer by a regulating magnetic pole S1 pole to convey in a direction of the regulation member 42. A layer thickness of the developer bristled by magnetic force is regulated by the regulation member 42, and a developer layer of a predetermined thickness is formed on the developing sleeve 44 after passing through a gap between the developing sleeve 44 and the regulation member 42.

The developer layer is borne and conveyed to the developing area facing the photosensitive drum 1A via the conveyance magnetic pole N1 pole and develops the electrostatic latent image which has been formed on the surface of the photosensitive drum 1A in a condition in which magnetic bristles are formed by the developing magnetic pole S2 pole. The developer after being provided for the development is conveyed to a peeling area where the peeling magnetic pole S3 pole is repulsive to the regulating magnetic pole S1 pole via the conveyance magnetic pole N2 pole and peeled off from the developing sleeve 44 in the peeling area, and thus the peeled developer returns to the developer container 41.

Toner Scattering

Here, scattering of the developer or mainly of the toner from the developing apparatus 4A will be described. Lately, the image forming apparatus is required from the market to further improve image quality. In order to achieve such high-quality image, it is required to place the toner faithfully to the electrostatic latent image. Then, as its effective means, highly fine toner acquired by micronization of toner particle size is used. However, because weight of the toner per one particle of the micronized toner is small, there is a possibility that the toner scatters away from the developing apparatus and stains an inside of the image forming apparatus and an output image.

There is a case where such toner scattering problem occurs in particular between the developing sleeve 44 and the photosensitive drum 1A, and the scattered toner is apt to accumulate within the image forming apparatus. Then, the scattered toner sometimes soils the roller and others conveying the recording member within the image forming apparatus and causes image soiling (referred to also as "roller soiling" hereinafter) such as a roller trace on the output image.

Figure 3:
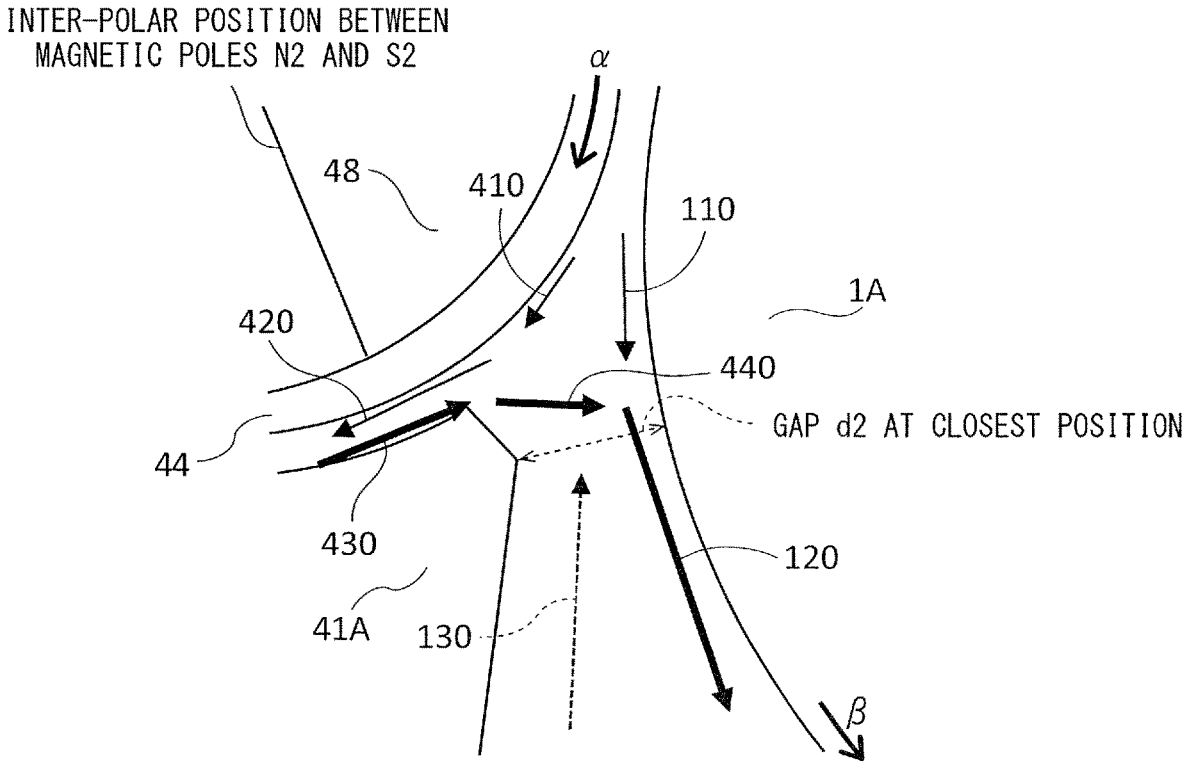
FIG. 3 is a schematic diagram illustrating states of air currents and flows of toner between a developing sleeve and a photosensitive drum in a first comparative example.

A mechanism of causing such scattered toner between the developing sleeve 44 and the photosensitive drum 1A will be described with reference to a first comparative example as illustrated in FIG. 3. FIG. 3 is a diagram illustrating states of air currents and flows of the toner downstream, in the rotation direction of the photosensitive drum 1A, of the developing area between the developing sleeve 44 and the photosensitive drum 1A in a section orthogonal to the rotation axial direction of the developing sleeve 44.

In FIG. 3, a dot line indicates a gap d2 at a closest position between the photosensitive drum 1A and a developer container 41A. Note that the configuration of the first comparative example is the same with the first embodiment except of the gap d2 at the closest position between the photosensitive drum 1A and the developer container 41A. In FIG. 3, arrows of solid lines indicate flows of air currents containing the toner, and a thickness thereof indicates a flowing toner amount. An arrow of a dot line indicates an air current containing almost no toner, and a thickness thereof indicates a flow rate of the air current.

The developing sleeve 44 and the photosensitive drum 1A generate air currents on their surfaces as they are rotationally driven. The air currents generated by the rotation of the developing sleeve 44 will be denoted as sleeve air currents 410 and 420 and the air currents generated by the rotation of the photosensitive drum 1A will be denoted as drum air currents 110 and 120. Air pressure within the developer container 41A rises because the sleeve air current 420 flows in and an air current 430 going out of the developer container 41A is generated. The toner within the developer container 41A flows outside by being entrained by the air current 430, being entrained by an air current 440 and being scattered along the drum air current 120. The toner entrained by the drum air current 120 spreads outside at end portions in the rotation axial direction of the developing sleeve 44 in particular and leads to image defects such as the roller trace.

In the case of the first comparative example in FIG. 3, no air will go in and out because the gap at the developing area between the developing sleeve 44 and the photosensitive drum 1A is filled by the developer. Therefore, air in the area between the developing sleeve 44 and the photosensitive drum 1A, downstream in the rotation direction of the photosensitive drum 1A of the developing area, only goes out by being entrained by the sleeve air current 410 and the drum air current 110. Accordingly, air pressure of this area is negative. As a result, a drum return air current 130 in a direction opposite to the drum air currents 110 and 120 is generated toward the negative spot. In the case of the first comparative example however, a force of the drum return air current 130 is very weak and has no power of pushing back the scattered toner because the gap d2 at the closest position between the photosensitive drum 1A and the developer container 41A is large.

Configuration of Present Embodiment

Figure 4:
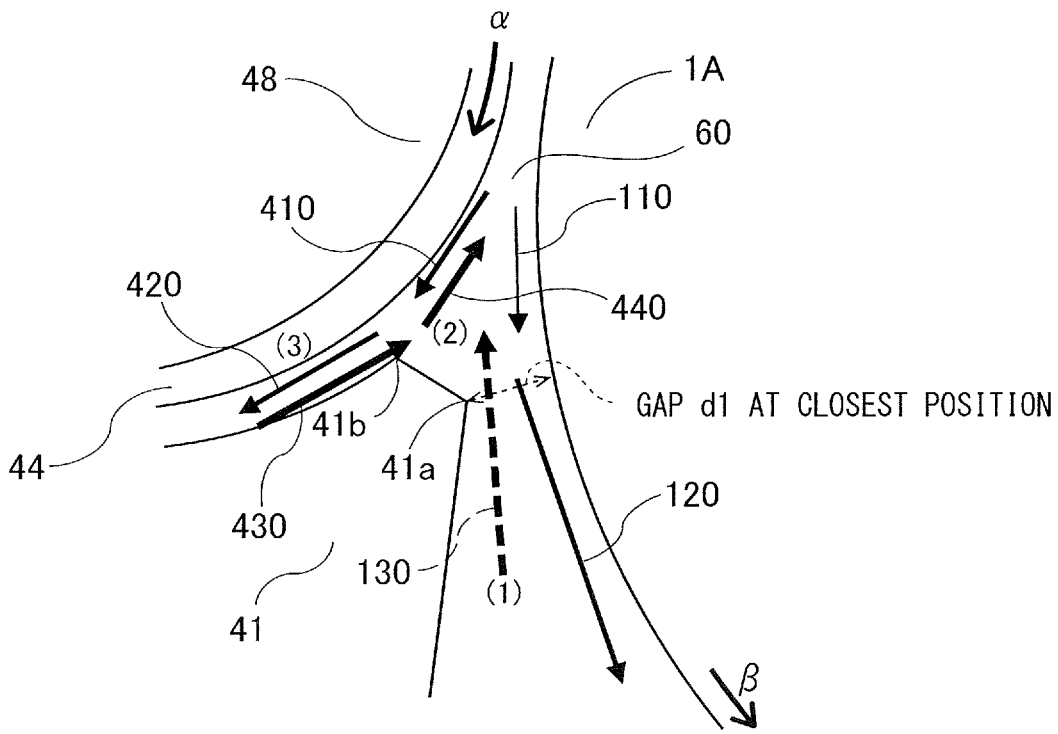
FIG. 4 is a schematic diagram illustrating states of air currents and flows of toner between the developing sleeve and the photosensitive drum according to a first embodiment.

Meanwhile, in a case of a configuration of the present embodiment as illustrated in FIG. 4, a gap d1, i.e., a distance between the developer container and the image bearing member, at a closest position where the developer container 41 is closest to the photosensitive drum 1A on a side downstream of the developing sleeve 44 (downstream of the opening 60) in the rotation direction of the developing sleeve 44 is narrower than the gap d2 of the first comparative example. Note that the gap d1 is a distance between the developer container 41 and the photosensitive drum 1A within an arbitral vertical plane including the developing sleeve 44 and being orthogonal to the rotation axial line of the developing sleeve 44.

The closest position is also at least an end portion of the area where the developer container 41 faces the photosensitive drum 1A in terms of a width direction of the developing sleeve 44 intersecting with the rotation direction thereof. That is, the developer container 41 comes close to the photosensitive drum 1A at least at the end areas in the rotation axial direction of the developing sleeve 44 so as to define the closest position. Note that the width direction is the rotation axial direction of the developing sleeve 44 and is a longitudinal direction of the developing sleeve 44 and the developing apparatus 4A.

In the present embodiment, the closest position extends in an entire range of the area where the developer container 41 faces the photosensitive drum 1A in terms of the width direction of the developer container 41. That is, a part of the developer container 41 closest to the photosensitive drum 1A, downstream of the developing sleeve 44 in terms of the rotation direction of the developing sleeve 44, is set to be a closest portion 41*a*. In this case, the closest portion 41*a* faces the photosensitive drum 1A through the gap d1 in the entire range of the width direction. In other words, the developer container 41 comes close to the photosensitive drum 1A in the entire range in the rotation axial direction of the developing sleeve 44 and defines the closest position.

Figure 2:
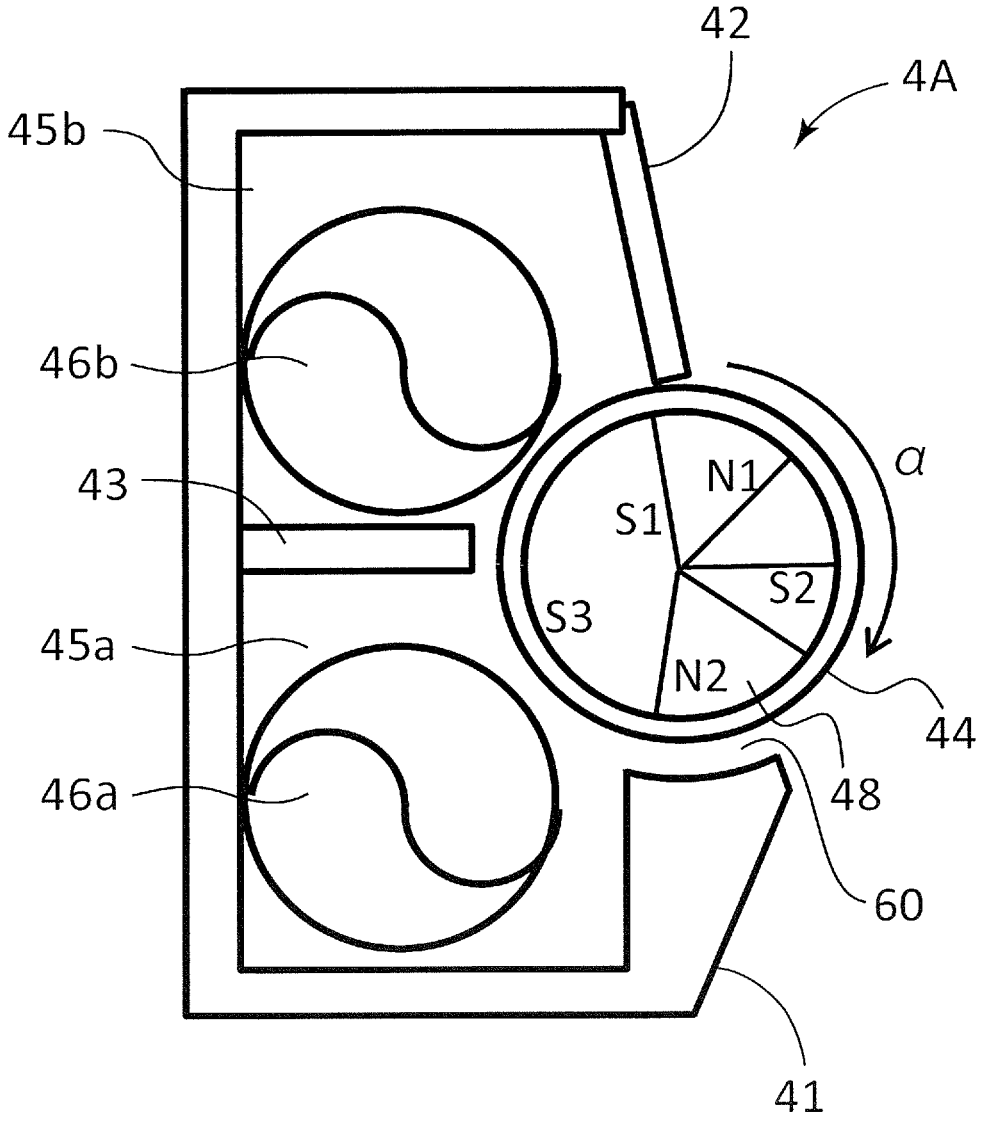
FIG. 2 is a schematic section view illustrating a configuration of a developing apparatus of the first embodiment.

The part facing the photosensitive drum 1A of the developer container 41 is opened as illustrated in FIG. 2, and the developing sleeve 44 is disposed such that the part thereof is exposed out of this opening. The closest portion 41*a* described above is a part closest to the photosensitive drum 1A in a part opposite to the side where the regulation member 42 is disposed across the opening in the developer container 41. In the present embodiment, the closest portion 41*a* is closer to the photosensitive drum 1A than an edge portion 41*b*, defining the opening and facing the developing sleeve 44, of the developer container 41 and is positioned, downstream in the rotation direction of the photosensitive drum 1A, more than the edge portion 41*b* as illustrated in FIG. 4. That is, the closest portion 41*a* is positioned downstream of an upstream end portion, in the rotation direction of the developing sleeve 44, of the part of the developer container 41 facing the photosensitive drum 1A on a side downstream of the developing sleeve 44.

Here, in the case of the first comparative example described above, the gap d2 was 3.5 mm. Meanwhile, the gap d1, i.e., the distance between the developer container 41 and the photosensitive drum 1A at the closest position, is 2.5 mm or less in the case of the present embodiment. Note that the gap d1 is preferable to be 2.0 mm or less. However, the gap d1 is greater than a gap or a development gap at a position where the developing sleeve 44 and the photosensitive drum 1A approach most with each other. Here, the development gap is a gap or a distance between the developing sleeve 44 and the photosensitive drum 1A at the developing area and is 300 μm for example. Accordingly, the gap d1 is preferable to be 300 μm or more and more preferable to be 1.0 mm or more.

It is noted that the gap d1 between the developer container 41 and the photosensitive drum 1A was confirmed by inserting a gap measuring sheet whose thickness had been measured in advance into the gap from a lower side of FIG. 4. In the case of the present embodiment, a gap between the developing sleeve 44 and the developer container 41 was set to be 1 mm.

In the case of the present embodiment, it is possible to suppress the developer from scattering out of the developing apparatus 4A by reducing the gap d1 between the developer container 41 and the photosensitive drum 1A as described above. That is, it is possible to reduce the toner from scattering out of the developing apparatus 4A by the following three steps:

(1) Increases flow rate of the drum return air current 130 by narrowing the gap d1, (2) The drum return air current 130 whose flow rate has been increased pushes back the scattered toner to the developing sleeve 44 side, and (3) The pushed back toner is entrained by the sleeve air current 410 and returns to the developer container 41.

The steps (1) through (3) approximately correspond to positions of the air currents (1) through (3) indicated in FIG. 4.

As described above, according to the present embodiment, it is possible to increase the flow rate of the drum return air current 130 and to suppress the toner from scattering by reducing the gap d1 between the developer container 41 and the photosensitive drum 1A. As a result, roller traces are hardly generated on the recording material by the scattered toner.

First Example

Next, an experiment carried out to verify the effect of the present embodiment will be described. The experiment was carried out by using the image forming apparatus 100 as illustrated in FIG. 1 and by mounting a developing apparatus of the first comparative example and a developing apparatus of the first example constituting the present embodiment at the positions of the developing apparatuses 4A through 4D. Then, an image forming process of forming an image of 50% of image ratio on 40,000 sheets of A4 size sheets was carried out to confirm whether roller soiling occurs in the output images. The experiment was carried out within an experimental room of 30° C. of temperature and of 80% of humidity. The gap d2 of the first comparative example was 3.5 mm and the gap d1 of the first example was 2.0 mm. Table 1 indicates results of the experiment:

TABLE 1

| | DISTANCE d1, d2 BETWEEN DEVELOPER CONTAINER 41, 41A AND PHOTOSENSITIVE DRUM 1A | ROLLER SOILING |
|---|---|---|
| FIRST COMPARATIVE EXAMPLE | 3.5 mm | OCCURRED |
| FIRST EXAMPLE | 2.0 mm | INSIGNIFICANT |

As illustrated in Table 1, the roller soiling occurred in the first comparative example. Meanwhile, such roller soling was insignificant in the first example.

Second Embodiment

A second embodiment will be described below with reference to FIG. 5. While the gap at the closest position between the developer container 41 and the photosensitive drum 1A was reduced in the entire widthwise range in the first embodiment described above, the gap at the closest position is reduced only at both end portions in the width direction in the present embodiment. Because other configurations and operations of the present embodiment are the same with those of the first embodiment described above, their descriptions and illustrations will be omitted or simplified, and the following description will be made centering on parts different from the first embodiment.

Figure 5:
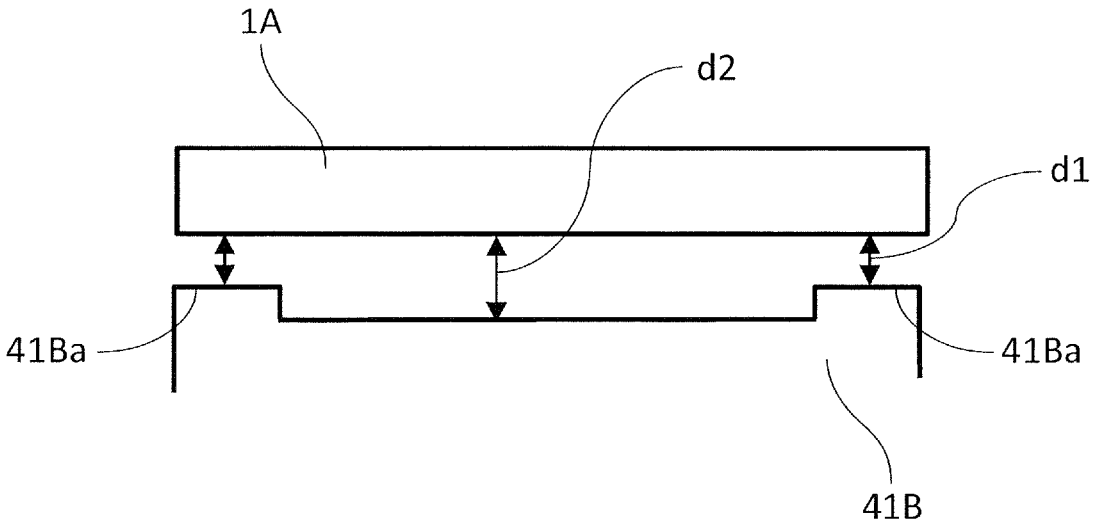
FIG. 5 is a schematic diagram illustrating a positional relationship, in terms of a rotation axial direction of the developing sleeve, at a closest position between the photosensitive drum and the developer container according to a second embodiment.

FIG. 5 illustrates a positional relationship between a developer container 41B and the photosensitive drum 1A of the present embodiment along the rotation axial direction of the developing sleeve 44 (see FIG. 2 and others). In a case of the present embodiment, gaps of both widthwise end portions between the developer container 41B and the photosensitive drum 1A on the side downstream of the developing sleeve 44 in the rotation direction of the developing sleeve 44 are reduced more than a gap between the developer container 41B and the photosensitive drum 1A at the widthwise center portion. In a case of FIG. 5, projections 41Ba that project toward the photosensitive drum 1A more than the widthwise center portion are provided respectively at both widthwise end portions of the developer container 41B.

In the present embodiment, the gap d2 at the widthwise center portion is equalized with that of the first comparative example and the gaps d1 at the widthwise both end portions are set to be 2.5 mm or less or more preferably to be 2.0 mm or less similarly to the first embodiment. A width or a widthwise length of each of the widthwise both end portions of the gap d1 is 50 mm from both widthwise ends of the photosensitive drum 1A. Note that a widthwise length of the developing sleeve 44 is 330 mm in this case.

As described above, the toner scattering out of the developer container is apt to spread outside at the rotation axial direction end portions, i.e., at the widthwise end portions, of the developing sleeve 44. Due to that, it is possible to suppress the toner from scattering out of the developing apparatus and to suppress the roller soiling by reducing the gaps d1 of the widthwise both end portions at the closest position like the present embodiment.

A similar experiment with the first example was carried out to verify the effect of the present embodiment. Note that the second example is the configuration of the present embodiment. The gap d1 of the second example was set to be 2.0 mm and the gap d2 to be 3.5 mm. Table 2 indicates also the results of the first comparative example and the first example. Note that while the closest position extends in the entire widthwise range in the first comparative example and the first example, the closest position extends only at both widthwise end portions in the second example.

TABLE 2

| | DISTANCE d1, d2 BETWEEN DEVELOPER CONTAINER 41, 41A, 41B AND PHOTOSENSITIVE DRUM 1A | CLOSEST POSITION (WIDTH DIRECTION) | ROLLER SOILING |
|---|---|---|---|
| FIRST COMPARATIVE EXAMPLE | 3.5 mm | ENTIRE WIDTHWISE RANGE | OCCURRED |
| FIRST EXAMPLE | 2.0 mm | ENTIRE WIDTHWISE RANGE | INSIGNIFICANT |
| SECOND EXAMPLE | 2.0 mm | BOTH END PORTIONS | INSIGNIFICANT |

As indicated in Table 2, the roller soiling was insignificant in the second example similarly to the first example. Accordingly, it was found that it is possible to obtain the same effect of suppressing the developer from scattering out of the developer container by reducing the gaps of only both widthwise end portions.

Third Embodiment

A third embodiment will be described below with reference to FIG. 6. In the first embodiment described above, the closest portion 41*a* is positioned downstream of the upstream end portion, in the rotation direction of the developing sleeve 44, of the part of the developer container 41 facing the photosensitive drum 1A at downstream of the developing sleeve 44. Meanwhile, according to the present embodiment, a closest portion 41Ca is provided at an upstream end, in the rotation direction of the developing sleeve 44, of the part of a developer container 41C facing the photosensitive drum 1A at the downstream side of the developing sleeve 44. Because other configurations and operations of the present embodiment are the same with the first embodiment described above, the same components will be denoted by the same reference numerals and their descriptions and illustrations will be omitted or simplified. The following description will be made centering on a part different from that of the first embodiment.

Figure 6:
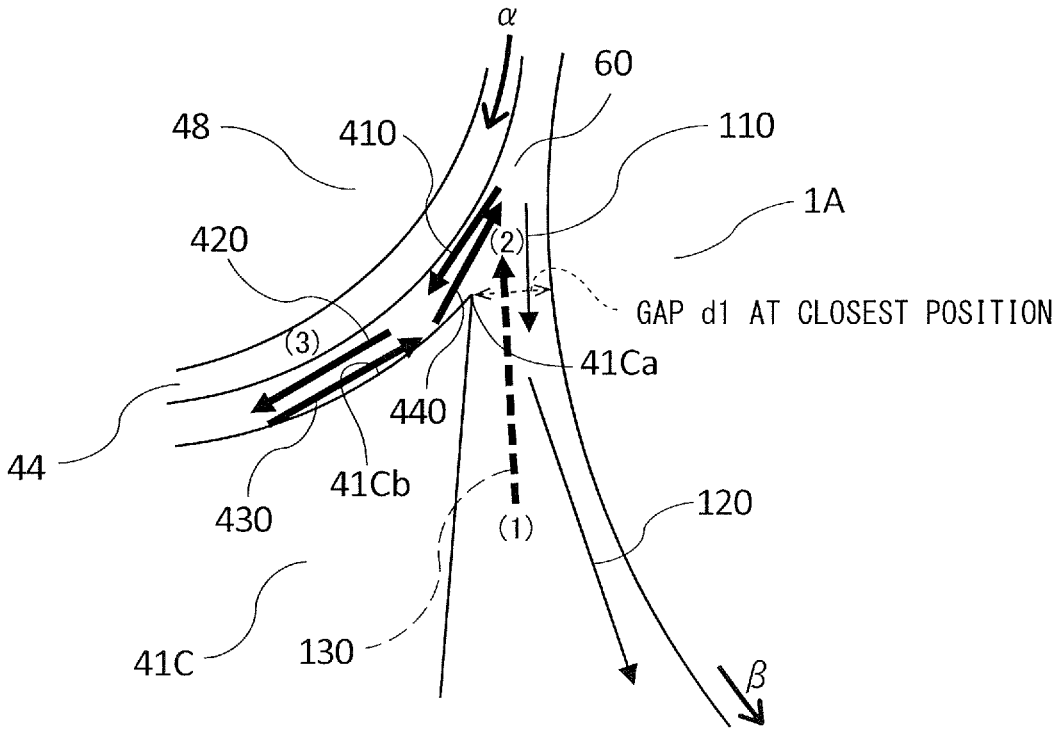
FIG. 6 is a schematic diagram illustrating states of air currents and flows of toner between the developing sleeve and the photosensitive drum according to a third embodiment.

As illustrated in FIG. 6, in the case of the present embodiment, the closest position between the developer container 41C and the photosensitive drum 1A on the downstream side of the developing sleeve 44 in the rotation direction of the developing sleeve 44 is an upstream end portion of an area where the developer container 41 faces the developing sleeve 44 on the downstream side. Therefore, according to the present embodiment, an edge portion, defining the opening and facing the developing sleeve 44, of the downstream part of the developer container 41C which is disposed downstream of the developing sleeve 44, and facing the photosensitive drum 1A, is set to be the closest portion 41Ca. That is, the edge portion of the developer container 41C defining the opening 60 on the downstream side in the rotation direction of the developing sleeve 44 is the closest portion 41Ca. Therefore, the closest portion 41Ca is located at an end portion, on the photosensitive drum 1A side, of a counter face 41Cb of the developer container 41C facing the developing sleeve 44 on the side downstream of the developing sleeve 44.

Then, the gap d1 at the closest position between the developer container 41C and the photosensitive drum 1A was set to be 2.5 mm or less or more preferably to be 2.0 mm or less in the entire widthwise range similarly to the first embodiment. It is possible to suppress the developer from scattering out of the developing apparatus 4A in the same manner with the first embodiment by reducing the gap d1 between the developer container 41C and the photosensitive drum 1A also in the present embodiment. The meaning of the air currents (1) through (3) indicated in FIG. 6 is the same with (1) through (3) indicated in FIG. 4.

According to the present embodiment in particular, it is possible to suppress the toner more from scattering out of the developer container 41 because the closest portion 41Ca where the gap d1 between the developer container 41C and the photosensitive drum 1A is 2.5 mm or less is located at the upstream end portion of the area where the developer container 41 faces the developing sleeve 44. That is, when the drum return air current 130 pushes back the toner to the developing sleeve 44 side at (2) in FIG. 6, the drum return air current 130 whose flow rate has been increased at (1) hits against an air current 440 containing the toner while not attenuating its flow rate as compared to the configuration of the first embodiment. Due to that, an amount of the toner returning to a sleeve current 410 at (3) increases more than the case of the first embodiment, and it is more possible to suppress the toner from scattering along the drum current 120.

Third Example

In order to verify the effect of the present embodiment, the similar experiment with the first example was carried out. Table 3 indicates experimental results. Note that the third example is the configuration of the present embodiment. The gap d1 of the third example was set to be 2.0 mm. Table 3 also indicates the results of the first comparative example and of the first and second examples. While the closest position extends in the widthwise entire range in the first comparative example and in the first and third examples, the closest positions are located only at both widthwise end portions in the second example.

In the first comparative example and in the first and second examples, the closest position is located downstream of the upstream end portion, in the rotation direction of the developing sleeve 44, of the part of the developer container facing the photosensitive drum 1A. Meanwhile, the closest position is located at the upstream end portion, in the rotation direction of the developing sleeve 44, of the part of the developer container facing the photosensitive drum 1A in the third example. In Table 3, these arrangements are presented in a column of "closest position (section)" such that the case of the first comparative example and the first and second examples as "container middle" and the case of the third example as "container edge".

TABLE 3

| | DISTANCE d1, d2 BETWEEN DEVELOPER CONTAINER 41, 41A, 41B, 41C AND PHOTOSENSITIVE DRUM 1A | CLOSEST POSITION (WIDTH DIRECTION) | CLOSEST POSIDON (CROSS-SECTION) | ROLLER SOILING |
|---|---|---|---|---|
| FIRST COMPARATIVE EXAMPLE | 3.5 mm | ENTIRE WIDTHWISE RANGE | CONTAINER MIDDLE | OCCURRED |
| FIRST EXAMPLE | 2.0 mm | ENTIRE WIDTHWISE RANGE | CONTAINER MIDDLE | INSIGNIFICANT |
| SECOND EXAMPLE | 2.0 mm | BOTH END PORTIONS | CONTAINER MIDDLE | INSIGNIFICANT |
| THIRD EXAMPLE | 2.0 mm | ENTIRE WIDTHWISE RANGE | CONTAINER EDGE | VERY INSIGNIFICANT |

As indicated in Table 3, the roller soiling was very insignificant in the third example as compared to the first and second examples. It was thus found that the effect of suppressing the developer from scattering can be obtained more by setting the closest portion 41Ca at a most upstream portion, in the rotation direction of the developing sleeve 44, of the developer container 41C.

Fourth Embodiment

A fourth embodiment will be described below with reference to FIGS. 7 and 8. In the case of the present embodiment, positions of the magnetic poles of a magnet roll 48A within the developing sleeve 44 are changed in the configuration of the third embodiment described above. Because other configurations and operations of the present embodiment are the same with the third embodiment described above, the same components will be denoted by the same reference numerals and their descriptions and illustrations will be omitted or simplified here. The following description will be made centering on a part different from that of the third embodiment.

At first, moves of the developer on the developing sleeve 44 and toner scattering states will be described with reference to FIG. 7. Note that FIG. 7 is an enlarged view schematically illustrating states of magnetic bristles of the developer carried and conveyed on the surface of the developing sleeve 44. Still further, the photosensitive drum 1A is not illustrated in FIG. 7. Postures of the magnetic bristles on the developing sleeve 44 move along magnetic lines of force generated by the respective magnetic poles.

Here, the magnet roll 48A serving as a magnetic field generating unit disposed and fixed within the developing sleeve 44 has a plurality of magnetic poles similarly to the magnet roll 48 illustrated in FIG. 2. Then, the developing magnetic pole S2 serving as a first magnetic pole is disposed at a position where the developing sleeve 44 faces the photosensitive drum 1A in the magnet roll 48A in terms of the rotation direction of the developing sleeve 44. Still further, the magnet roll 48A is provided with the conveyance magnetic pole N2 serving as a second magnetic pole differing from the developing magnetic pole S2 and disposed at a position adjacent downstream of the developing magnetic pole S2 and where the developing sleeve 44 faces the developer container 41C.

Figure 7:
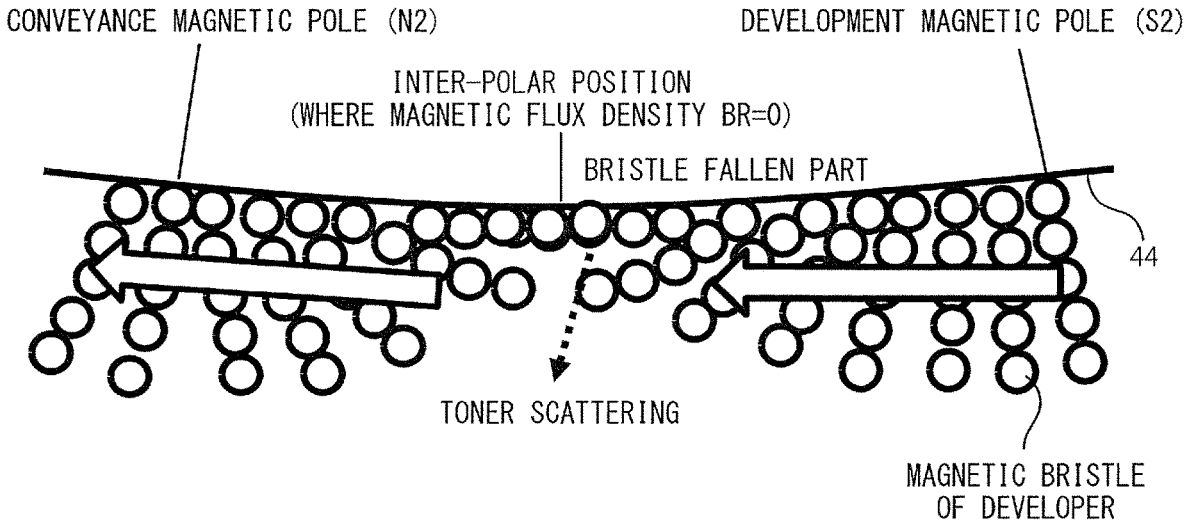
FIG. 7 is a schematic diagram illustrating a bristle state of the developer on the developing sleeve according a fourth embodiment.

As illustrated in FIG. 7, while the magnetic bristles rise at the developing magnetic pole S2, i.e., the first magnetic pole, and the conveyance magnetic pole N2, i.e., the second magnetic pole, the bristles are laid at an interpolar position where a vertical component of magnetic flux density with respect to the developing sleeve 44 Br=0. That is, the magnetic bristles are fallen at the interpolar position between the developing magnetic pole S2 and the conveyance magnetic pole N2 where the magnetic flux density is zeroed. This part will be called as a bristle fallen part.

Therefore, the magnetic bristles of the developer conveyed from the developing magnetic pole S2 fall down toward the interpolar position and collide against the developing sleeve 44 and other bristles, scattering the toner at this time. Therefore, the toner scattering from the developing sleeve 44 mainly occurs at the interpolar position between the developing magnetic pole S2 and the conveyance magnetic pole N2. In the present embodiment, the toner scattered thus from the developing sleeve 44 is suppressed by using the drum return air current 130.

Figure 8:
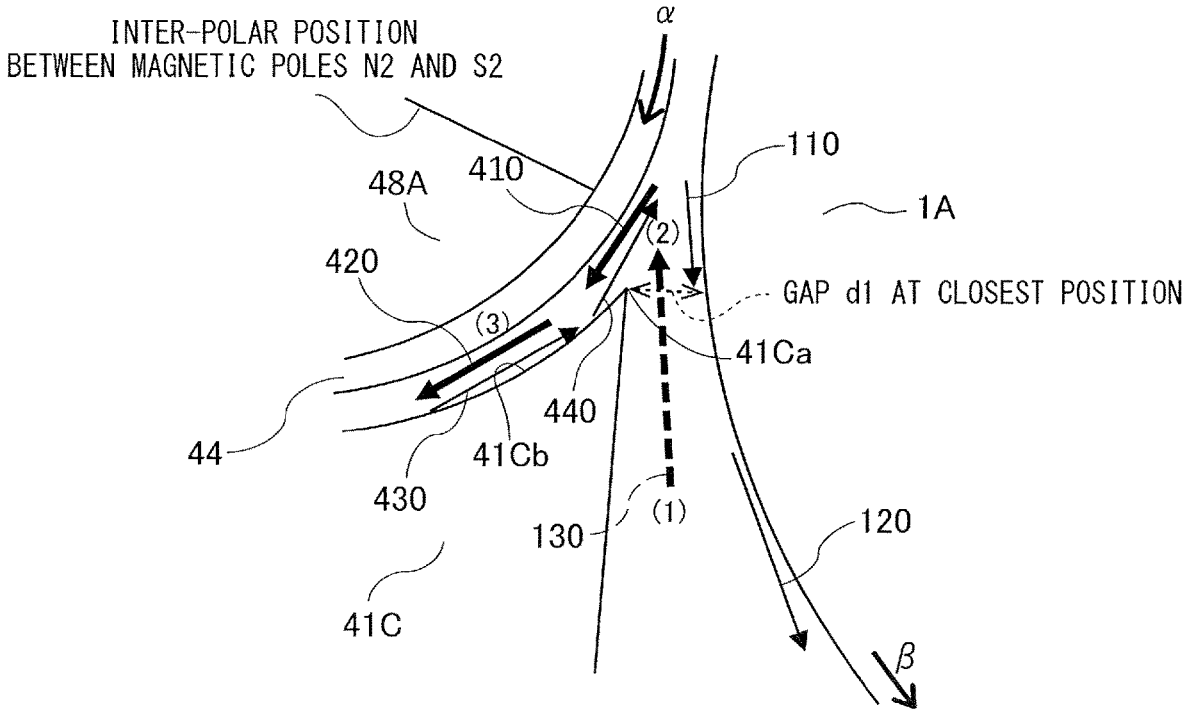
FIG. 8 is a schematic diagram illustrating states of air currents and flows of toner between the developing sleeve and the photosensitive drum according to the fourth embodiment.

FIG. 8 illustrates a configuration of the present embodiment. A straight line within the magnet roll 48A indicates a position where the magnetic flux density is zeroed at the interpolar position between the developing magnetic pole S2 and the conveyance magnetic pole N2, i.e., the interpolar position between the magnetic poles N2 and S2. Other configurations are the same with those of the third embodiment. Here, the interpolar position between the magnetic poles N2 and S2 is located within the area facing the developer container 41A in the first comparative example illustrated in FIG. 3. That is, the interpolar position of the magnetic poles N2 and S2 is covered by the developer container 41A. The same applies to the first through third embodiments.

Meanwhile, according to the present embodiment, the interpolar position of the magnetic poles N2 and S2 is located upstream of the upstream end portion of the area where the developer container 41C faces the developing sleeve 44 in terms of the rotation direction of the developing sleeve 44 as illustrated in FIG. 8. In the case in FIG. 8, the interpolar position of the magnetic poles N2 and S2 is located downstream of the developing area and upstream of the closest portion 41Ca in terms of the rotation direction of the developing sleeve 44. Therefore, it is possible to dispose the interpolar position of the magnetic poles N2 and S2, which is a source of the toner scattered on the developing sleeve 44, downstream of or right above the drum return air current 130 and to return the toner to the sleeve current 410 before it scatters. As a result, it is possible to suppress the toner from scattering from the developing sleeve 44.

Thus, it is possible to suppress not only the toner scattered by being entrained by the air current from the inside of the developer container 41C but also the toner scattered from the developer on the developing sleeve 44 by changing the interpolar position of the magnetic poles N2 and S2 of the magnet roll 48A from the configuration of the first comparative example. Note that the configuration of the interpolar position of the present embodiment is applicable to the above-mentioned first and second embodiment and also to a fifth embodiment described later.

Fourth Example

In order to verify the effect of the present embodiment, a similar experiment with the first embodiment was carried out. Table 4 indicates experimental results. Note that the fourth example is the configuration of the present embodiment. The gap d1 of the fourth example was set to be 2.0 mm. Table 4 indicates also the results of the first comparative example and the first through third examples. The closest position is indicated as "container edge" in the fourth example similarly to the third example.

In Table 4, the interpolar position of the magnetic poles N2 and S2 was indicated as "point where magnetic flux is zeroed". Because the point where magnetic flux is zeroed is located within the area facing the developer container 41A in the first comparative example and in the first through third examples, they are indicated as "facing container" in Table 4. Meanwhile, because the point where magnetic flux is zeroed is located upstream of the upstream end portion of the area where the developer container 41C faces the developing sleeve 44 in the fourth example, this arrangement is indicated as "between container and drum" in Table 4.

TABLE 4

| | DISTANCE d1, d2 BETWEEN DEVELOPER CONTAINER 41, 41A 41B, 41C AND PHOTOSENSITIVE DRUM 1A | CLOSEST POSITION (WIDTH DIRECTION) | CLOSEST POSITION (CROSS-SECTION) | POINT WHERE MAGNETIC FLUX DENSITY IS ZEROED | ROLLER SOILING |
|---|---|---|---|---|---|
| FIRST COMPARATIVE EXAMPLE | 3.5 mm | ENTIRE WIDTHWISE RANGE | CONTAINER MIDDLE | FACING CONTAINER | OCCURRED |
| FIRST EXAMPLE | 2.0 mm | ENTIRE WIDTHWISE RANGE | CONTAINER MIDDLE | FACING CONTAINER | INSIGNIFICANT |
| SECOND EXAMPLE | 2.0 mm | BOTH END PORTIONS | CONTAINER MIDDLE | FACING CONTAINER | INSIGNIFICANT |
| THIRD EXAMPLE | 2.0 mm | ENTIRE WIDTHWISE RANGE | CONTAINER EDGE | FACING CONTAINER | VERY INSIGNIFICANT |
| FOURTH EXAMPLE | 2.0 mm | ENTIRE WIDTHWISE RANGE | CONTAINER EDGE | BETWEEN CONTAINER AND DRUM | BARELY OCCURRED |

As indicated in Table 4, roller soiling barely occurred in the fourth example as compared to the third example. That is, it was a level on which roller soiling is barely recognizable. It was thus found that it is possible to suppress the toner from scattering from the developing sleeve 44 by disposing the interpolar position of the magnetic poles N2 and S2, which is the source of the toner scattering from the developing sleeve 44, right above the drum return air current 130.

Fifth Embodiment

A fifth embodiment will be described below with reference to FIGS. 9 through 12. Because the rotation direction of the developing sleeve at the position facing the photosensitive drum was downward, the developer scattered downward in the configuration of the first through fourth embodiments described above. Meanwhile, the present embodiment is configured such that the developer scatters upward. Due to that, while arrangements of the respective components of an image forming apparatus 100A are different from the arrangements of the respective components of the image forming apparatus 100 of the first embodiment, the basic configurations and operations of the respective components are same. Therefore, the same components will be denoted by the same reference numerals and their descriptions and illustrations will be omitted or simplified here. The following description will be made centering on a part different from that of the first embodiment.

Figure 9:
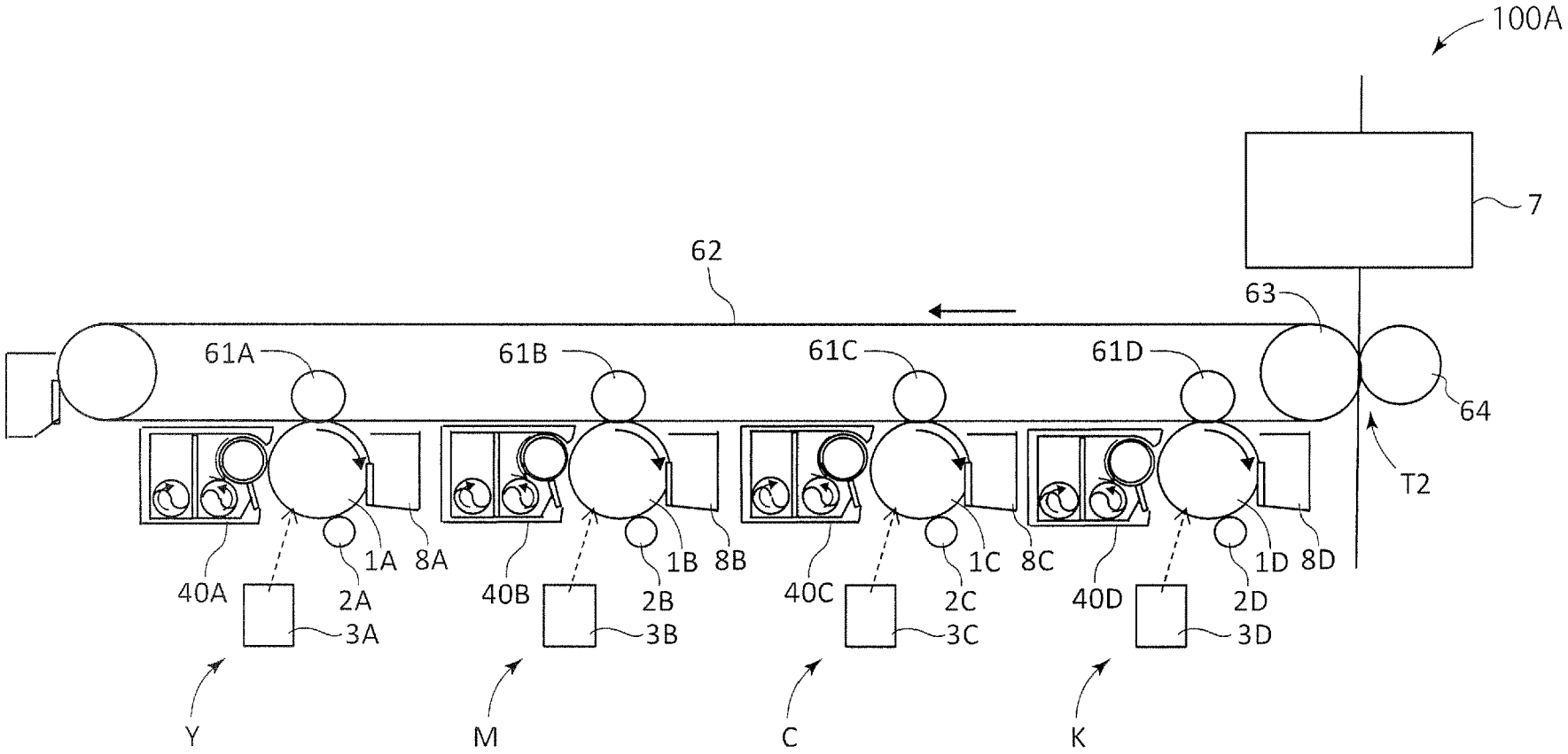
FIG. 9 is a schematic section view illustrating a configuration of an image forming apparatus according to a fifth embodiment.

FIG. 9 illustrates the image forming apparatus 100A of the present embodiment. While the image forming units Y, M, C and K are disposed above the intermediate transfer belt 62 in the image forming apparatus 100 illustrated in FIG. 1, the image forming units Y, M, C and K are disposed under the intermediate transfer belt 62 in the image forming apparatus 100A of the present embodiment. Still further, while a recording member onto which a toner image is to be transferred is in a horizontal direction in FIG. 1 in the image forming apparatus 100 illustrated in FIG. 1, a recording member onto which a toner image is to be transferred is conveyed in a vertical direction in FIG. 1 in the image forming apparatus 100A of the present embodiment. Still further, a configuration of each of developing apparatuses 40A through 40D of the image forming apparatus 100A of the present embodiment is different from that of the developing apparatuses 4A through 4D of the image forming apparatus 100 illustrated in FIG. 1. As for other configurations of the image forming apparatus 100A, basic configurations and functions thereof are the same with those of the image forming apparatus 100 in FIG. 1 except of their arrangement.

Developing Apparatus

Next, the developing apparatus 40A of the present embodiment will be described with reference to FIG. 10. Note that because the other developing apparatuses 40B, 40C and 40D have the same configuration with the developing apparatus 40A, their description and illustration will be omitted here. Note that the developing apparatus 40A is provided with a first developer conveyance path 45*a* and a second developer conveyance path 45*b* disposed laterally in FIG. 10 and to that end, a partition wall 43 is provided in a vertical direction in FIG. 10. That is, the second developer conveyance path 45*b* is arrayed in a horizontal direction with the first developer conveyance path 45*a* and the developing sleeve 44 is located above first and second agitating members 46*a* and 46*b*.

Figure 10:
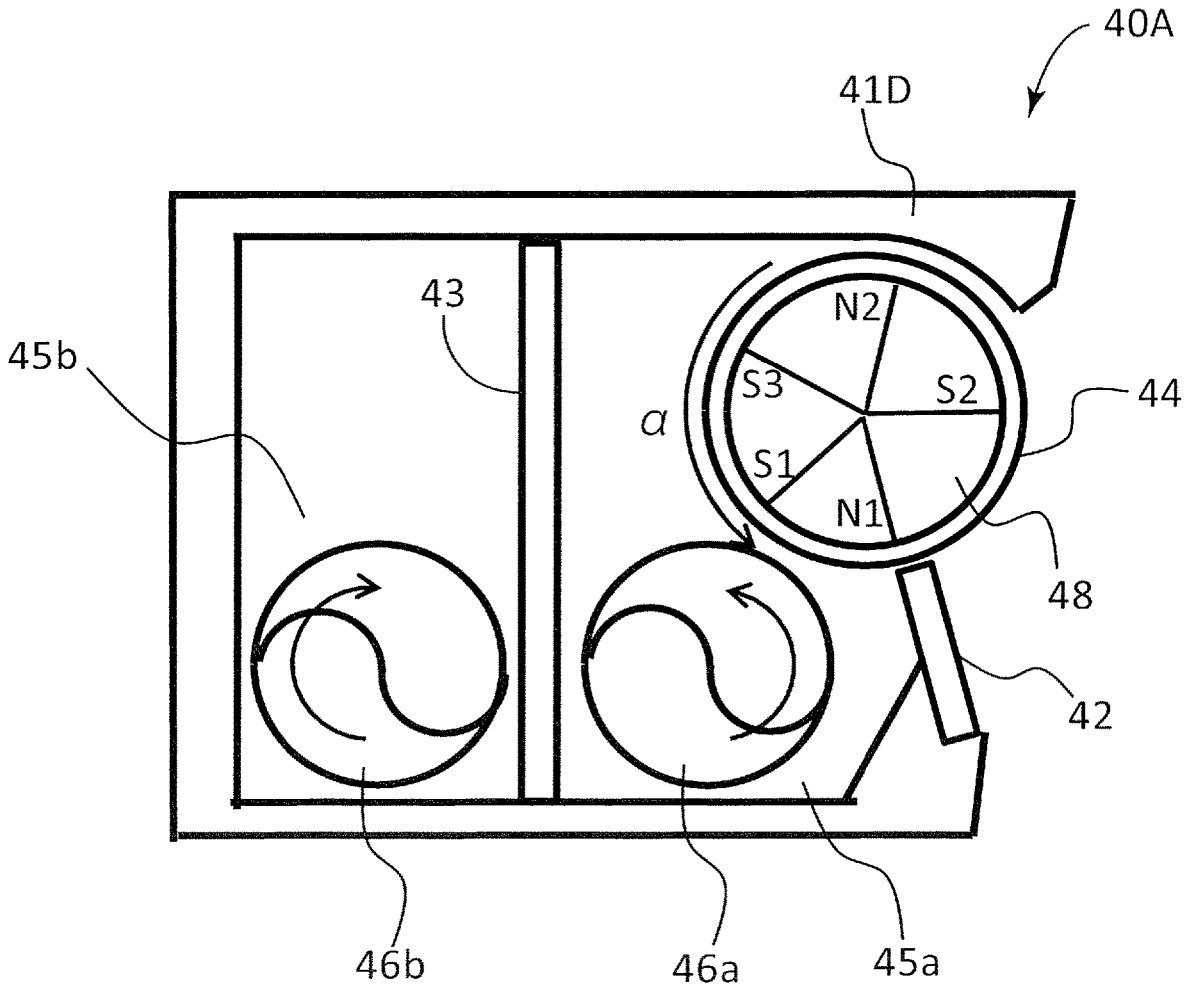
FIG. 10 is a schematic section view illustrating a configuration of a developing apparatus according to the fifth embodiment.

The developing sleeve 44 also rotates in a direction of an arrow a in FIG. 10, which is a rotation direction from a bottom to a top in FIG. 9, at a position facing the photosensitive drum 1A in FIG. 9. Therefore, the regulation member 42 is disposed under the developing sleeve 44. Still further, matching with the rotation direction of the developing sleeve 44, dispositions in the rotation direction of the developing sleeve 44 of the plurality of magnetic poles of the magnet roll 48 are inversed from the configuration illustrated in FIG. 2. Configurations and functions of respective parts of the developing apparatus 40A are the same with those of the developing apparatus 4A except of such arrangement of components, so that the same component will be denoted by the same reference numeral and their further description will be omitted here. Note that while the reference numeral of the developer container storing the developer is differentiated from that of the first embodiment, the basic configuration and functions are the same.

Figure 11:
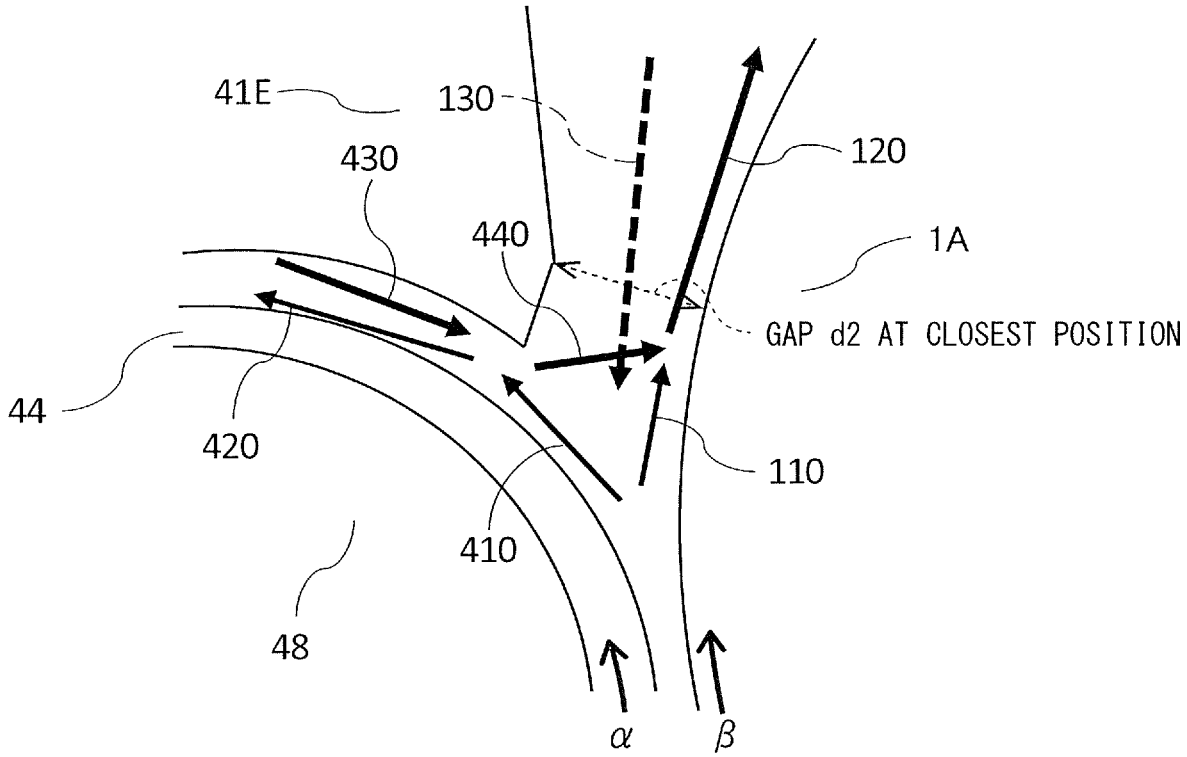
FIG. 11 is a schematic diagram illustrating states of air currents and flows of toner between the developing sleeve and the photosensitive drum according to a second comparative example.

FIG. 11 illustrates a configuration of a second comparative example. While FIG. 11 is similar to FIG. 3, a direction in which the developer scatters is different from the first comparative example because the rotation direction of the developing sleeve 44 of the second comparative example is different from the first comparative example illustrated in FIG. 3. Note that the configuration of the second comparative example is the same with the present embodiment except of the gap d2 at a closest position between the photosensitive drum 1A and the developer container 41E. Still further, meanings of arrows, solid lines and dot lines are the same with those in FIG. 3. In a case of such second comparative example, a mechanism by which the developer scatters is the same with that of the first comparative example illustrated in FIG. 3 except ef that the direction in which the developer scatters is different. Then, because the gap d2 at the closest position between the photosensitive drum 1A and the developer container 41E is large, a force of the drum return air current 130 was very weak and had no such power of pushing back the scattered toner also in the case of the second comparative example.

Figure 12:
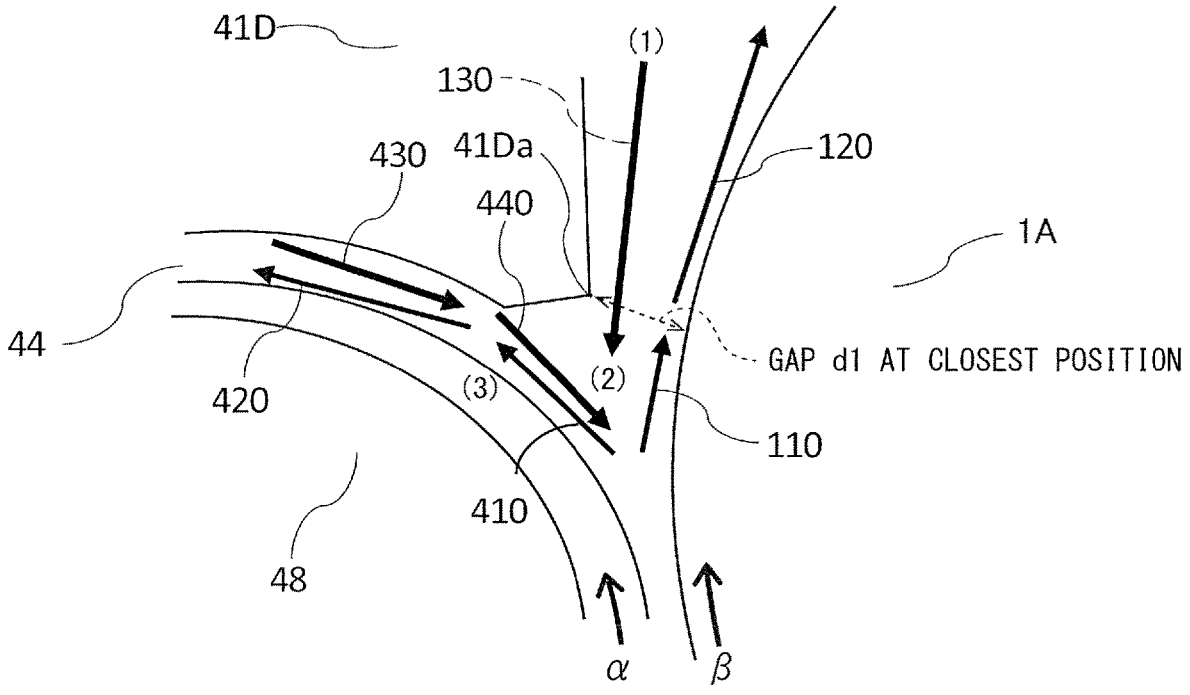
FIG. 12 is a schematic diagram illustrating states of air currents and flows of toner between the developing sleeve and the photosensitive drum according to the fifth embodiment.

Meanwhile, according to the present embodiment, the gap or a distance d1 at a closest position between the photosensitive drum 1A and a developer container 41D on the downstream side of the developing sleeve 44 in the rotation direction of the developing sleeve 44, is reduced to be less than the gap d2 of the second comparative example as illustrated in FIG. 12.

Still further, the closest position extends in the entire widthwise range of the area where the developer container 41D faces the photosensitive drum 1A also in the case of the present embodiment. That is, in terms of the rotation direction of the developing sleeve 44, a part of the developer container 41D closest to the photosensitive drum 1A downstream of the developing sleeve 44 is set to be a closest portion 41Da. In this case, the closest portion 41Da faces the photosensitive drum 1A through the gap d1 in the entire widthwise range.

The gap d1 is set to be 2.5 mm or less or more preferably to be 2.0 mm or less in the same manner with the first embodiment. Note that in the case of the second comparative example, the gap d2 was set to be 3.5 mm. The gap between the developing sleeve 44 and the developer container 41D was set to be 1.0 mm also in the case of the present embodiment.

It is possible to suppress the developer from scattering out of the developing apparatus 4A by reducing the gap d1 between the developer container 41D and the photosensitive drum 1A by the same mechanism with the first embodiment also in the case of the present embodiment. That is, it is possible to increase flow rate of the drum return air current 130 and to reduce the scattered toner also in the case of the present embodiment. As a result, a roller trace is barely generated by the scattered toner on a recording member.

Fifth Example

In order to verify the effect of the present embodiment, a similar experiment with the first example was carried out. Table 5 indicates experimental results. Note that the fifth example is the configuration of the present embodiment. The gap d1 of the fifth example was set to be 2.0 mm and the gap d2 of the second comparative example was set to be 3.5 mm.

TABLE 5

| | DISTANCE d1, d2 BETWEEN DEVELOPER CONTAINER 41D, 41E AND PHOTOSENSITIVE DRUM 1A | ROLLER SOILING |
|---|---|---|
| SECOND COMPARATIVE EXAMPLE | 3.5 mm | OCCURRED |
| FIFTH EXAMPLE | 2.0 mm | INSIGNIFICANT |

As indicated in Table 5, roller soiling occurred in the second comparative example. Meanwhile, roller soiling was insignificant in the fifth example. Accordingly, it was found that the developer scattering suppressing effect can be obtained in the same manner with the first embodiment even in the configuration in which the developer scatters upward.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-209081, filed Nov. 6, 2018, which is hereby incorporated by reference herein in its entirety.

What is claimed is:

1. An image forming apparatus, comprising:

a rotatable image bearing member; and a developing apparatus comprising:

a developer container configured to accommodate developer including toner and carrier;

a rotatable developer bearing member configured to bear and carry the developer in the developer container to a developing position where an electrostatic latent image formed on the image bearing member is developed; and a magnet non-rotationally fixed within the developer bearing member and having a first magnetic pole disposed at the closest position to the developing position, and a second magnetic pole disposed adjacent to the first magnetic pole and disposed downstream of the first magnetic pole in a rotation direction of the developer bearing member, wherein the shortest distance between the developer container and the image bearing member at a position at which the developer container is closest to the image bearing member and which is disposed downstream of the first magnetic pole and upstream of the second magnetic pole in the rotation direction of the developer bearing member on the developer container is 2.5 mm or less, and a position at which a magnetic flux density in a normal direction of the developer bearing member is zeroed and which is disposed downstream of the first magnetic pole and upstream of the second magnetic pole in the rotation direction of the developer bearing member on the developer bearing member is positioned upstream, in the rotation direction of the developer bearing member, of the position at which the developer container is closest to the image bearing member and which is disposed downstream of the first magnetic pole and upstream of the second magnetic pole in the rotation direction of the developer bearing member on the developer container.

2. The image forming apparatus according to claim 1, wherein the shortest distance between the developer container and the image bearing member is 2.5 mm or less across the entire area in which the developer container faces the image bearing member in a rotation axial direction of the developer bearing member and which is disposed downstream of the first magnetic pole and upstream of the second magnetic pole in the rotation direction of the developer bearing member.

3. The image forming apparatus according to claim 1, wherein the shortest distance between the developer container and the image bearing member at the position at which the developer container is closest to the image bearing member and which is disposed downstream of the first magnetic pole and upstream of the second magnetic pole in the rotation direction of the developer bearing member on the developer container is 2.0 mm or less.

4. The image forming apparatus according to claim 1, wherein the shortest distance between the developer container and the image bearing member at the position at which the developer container is closest to the image bearing member and which is disposed downstream of the first magnetic pole and upstream of the second magnetic pole in the rotation direction of the developer bearing member on the developer container is 1.0 mm or more.

5. The image forming apparatus according to claim 1, further comprising a developer regulation portion configured to regulate an amount of the developer born on the developer bearing member; and wherein a position where the developer bearing member is closest to the developer regulation portion on the developer bearing member is positioned above a rotation axis of the developer bearing member in a vertical direction.

6. The image forming apparatus according to claim 1, further comprising a developer regulation portion configured to regulate an amount of the developer born on the developer bearing member; and wherein a position where the developer bearing member is closest to the developer regulation portion on the developer bearing member is positioned below a rotation axis of the developer bearing member in a vertical direction.

* * * * *